United States Patent [19]

Thompson

[11] Patent Number: 4,506,796

[45] Date of Patent: Mar. 26, 1985

[54] DRUM STACKING RACK

[75] Inventor: Larry J. Thompson, Pembroke Pines, Fla.

[73] Assignee: Equipment Company of America, Hialeah, Fla.

[21] Appl. No.: 471,276

[22] Filed: Mar. 2, 1983

[51] Int. Cl.[3] ..... A47F 7/00

[52] U.S. Cl. ..... 211/59.4; 211/74; 108/55.3; 24/288

[58] Field of Search ..... 211/49 S, 74, 194; 108/55.3, 56.1; 248/68 CB; 410/49

[56] References Cited

U.S. PATENT DOCUMENTS

| | | | |
|---|---|---|---|
| 3,019,916 | 2/1962 | Malcher | 108/55.3 X |
| 3,746,178 | 7/1973 | Wagschal | 211/74 |
| 4,093,076 | 6/1978 | Newton | 211/74 |
| 4,190,165 | 2/1980 | Collins | 211/59.4 |

FOREIGN PATENT DOCUMENTS

| | | | |
|---|---|---|---|
| 1418284 | 10/1965 | France | 410/49 |

*Primary Examiner*—Ramon S. Britts
*Assistant Examiner*—Sarah A. Lechok
*Attorney, Agent, or Firm*—Cullen, Sloman, Cantor, Grauer, Scott & Rutherford

[57] ABSTRACT

A modular drum rack for storing and stacking drums. Two, three, four, or more laterally adjacent modules may be assembled together in a unit, to accommodate an equal number of drums in a single tier. Subsequent tiers can be stacked upon one another to form a drum stacking rack. The modules include openings for receiving fork truck tines to allow the units to be moved by a fork truck. Openings are provided on four sides of the units to permit handling from all directions. Two sets of openings are provided on the front and back of the unit to provide a balanced lift point for the unit with either an even number of drums or an odd number of drums. When the units are empty they are adapted to be interlocked with one another to reduce space requirements for return shipment.

10 Claims, 7 Drawing Figures

FIG. 1
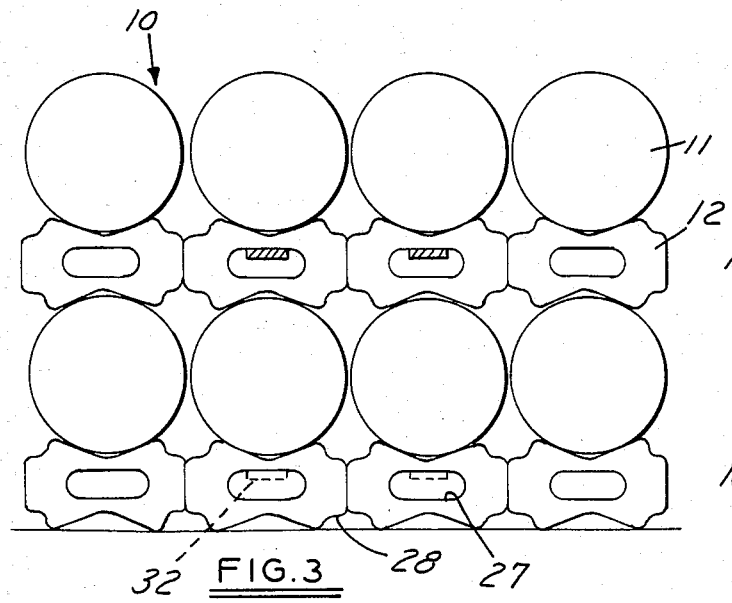
FIG. 2
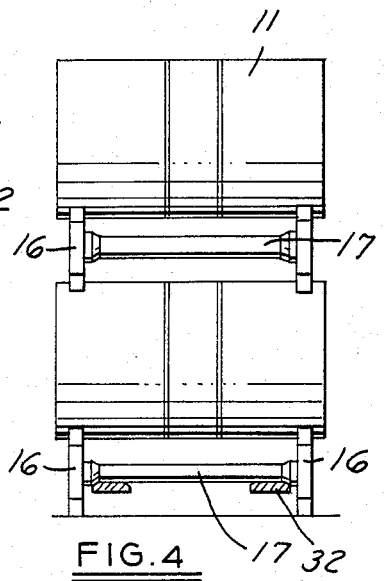
FIG. 3
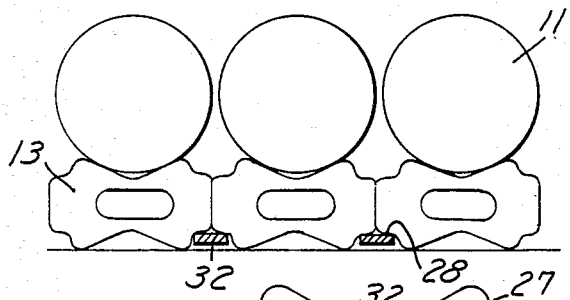
FIG. 4
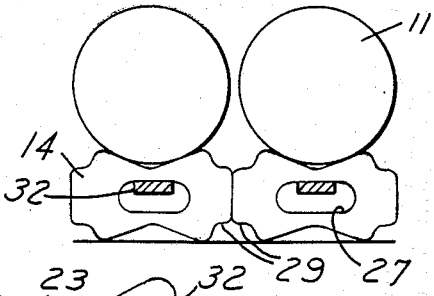
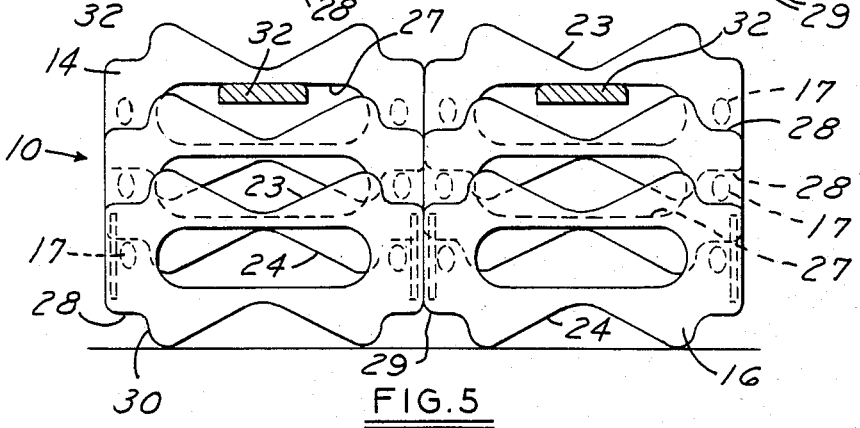
FIG. 5

DRUM STACKING RACK

BACKGROUND OF THE INVENTION

1. Technical Field

The present invention is related to a rack for stacking storage drums. More specifically, the rack is a modular unit that is assembled together in various combinations of modules to provide a modular unit that may be tiered upon drums stored on another modular unit.

2. Prior Art

Storage drums, available in 55 gallon and 30 gallon sizes, are commonly stored in large racks made of tubing and channel members welded together to form a rack. Such racks are permanently built up for use in a designated area. It is difficult to add to the rack if additional drum storage is needed and the rack is not designed to be disassembled. Welded drum stacking racks are unwieldy and are not usually used for transporting drums.

One improvement over welded drum stacking racks is a double drum rack sold by Equipment Company of America. Each double drum storage rack is adapted to receive two 55 gallon drums on its top surface. A second tier comprising a rack and two more drums may be stacked on the top surface of the first two drums. This type of drum rack may be stacked up to a maximum height of five tiers and is well suited for shipping drums. The double drum racks include fork truck tine openings for handling the rack with the drums stacked thereon. The double drum racks overcome many of the disadvantages of prior art welded drum storage racks because they may be moved easily with drums stored thereon and total storage capacity may be increased by simply adding additional tiers of racks or starting new columns of drum storage racks.

In double drum racks there is no provision for building upon the modules laterally to create rack modules capable of carrying three, four, or more drums in a row. If racks having more than two rows were required it would be necessary to specially design racks to carry higher multiples of drums. The parts, particularly end plates, required to make up a three, four, or larger drum rack would be expensive to manufacture and difficult to assemble. The double drum racks are limited to use with a particular size of drum and may not be tiered upon racks bearing other size drums.

These and other problems have been solved by the present invention as will hereinafter be described.

SUMMARY OF THE INVENTION

The present invention relates to a simple, easy to assemble, modular drum rack that is adapted to be assembled in multiples of two, three, four, or more units for ease of handling and storing different multiples of drums. The modular drum racks can be handled in groups and tiered one on top of another.

The modular drum rack of the present invention is accessible from any of its four sides. The front and rear of the modular drum rack are provided with two sets of openings for handling an even or odd number of drums on a given rack. The rack may thereby always be lifted with the weight of the drums balanced across the fork truck tines.

The modular drum rack of the present invention includes top and bottom portions that are adapted to retain or be retained on 30 gallon, 55 gallon or other size drums. The modular drum racks are designed to be tiered up to five high. The rack of the present invention will accommodate stacking tiers of 55 and 30 gallon drums in alternating layers, if required, without any loss of stability.

The modular drum stacking racks are well suited for storage applications because they are extremely stable.

The modular drum racks are ideal for shipping because the racks may be stacked interlocked with one another when empty to reduce freight charges for return shipment.

Another advantage of the drum stacking rack according to the present invention is that it is made up of identical symmetrical parts that are simple to assemble together into a drum stacking rack for various numbers of drums. The modular construction of the drum stacking rack also lends itself to easy repair since a damaged part of the rack may be replaced simply without having to discard the entire assembly. The number of replacement parts necessary to repair racks and build different multiples of racks is very low since the number of different parts used to build each module is kept to a minimum.

These and other advantages of the present invention will become apparent after studying the following detailed description of the invention in view of the attached drawings and appended claims.

BRIEF DESCRIPTION OF THE DRAWINGS

FIG. 1 is a front elevational view of two tiered four module units with fork truck tines shown in cross-section for lifting one or both of the units.

FIG. 2 is a side elevational view of two tiers of drums stacked on drum storage racks with fork truck tines shown in cross-section in position for lifting the unit.

FIG. 3 is a front elevational view of a three module unit with fork truck tines shown in cross-section in position for lifting the unit.

FIG. 4 is a front elevational view of a two module unit with fork truck tines shown in cross-section in position for lifting the unit.

FIG. 5 is a front elevational view of three drum storage racks stacked together for shipment.

DETAILED DESCRIPTION OF THE PREFERRED EMBODIMENT

Figure 6:
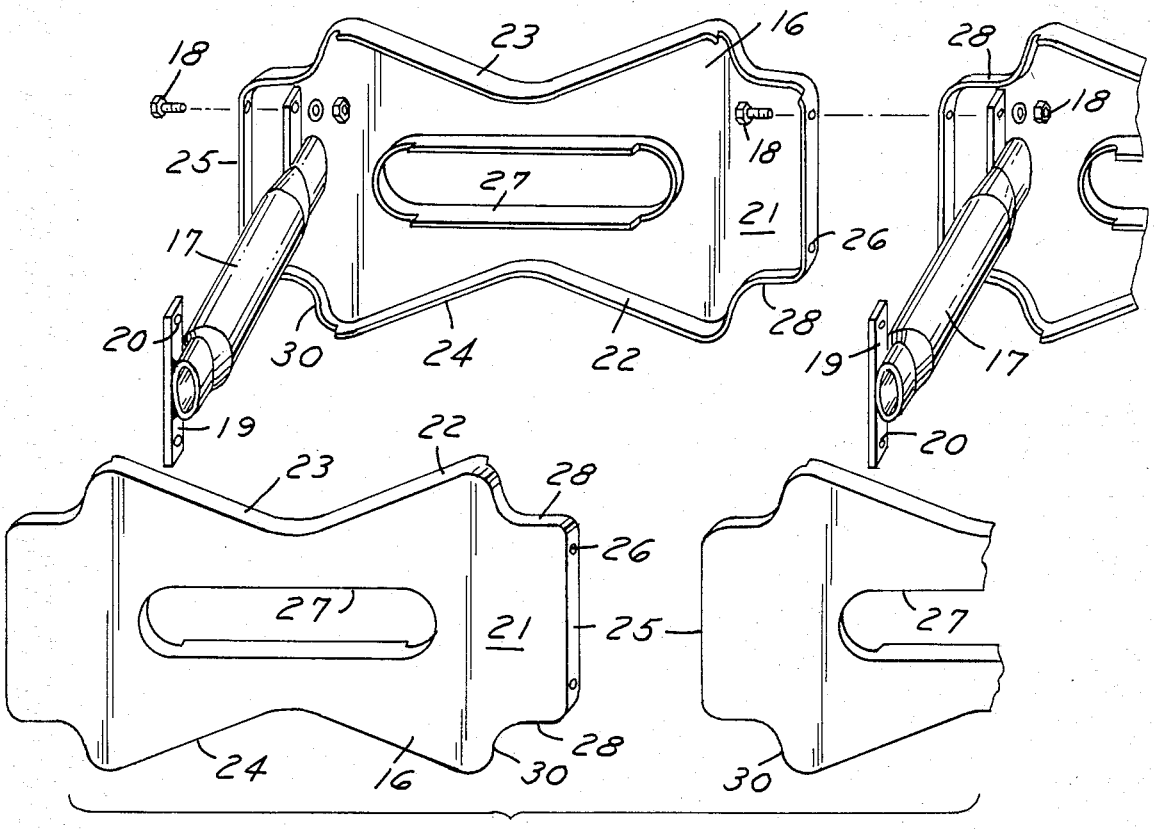
FIG. 6 is an exploded perspective view of one module and a fragmentary exploded perspective view of an adjacent module.
Figure 7:
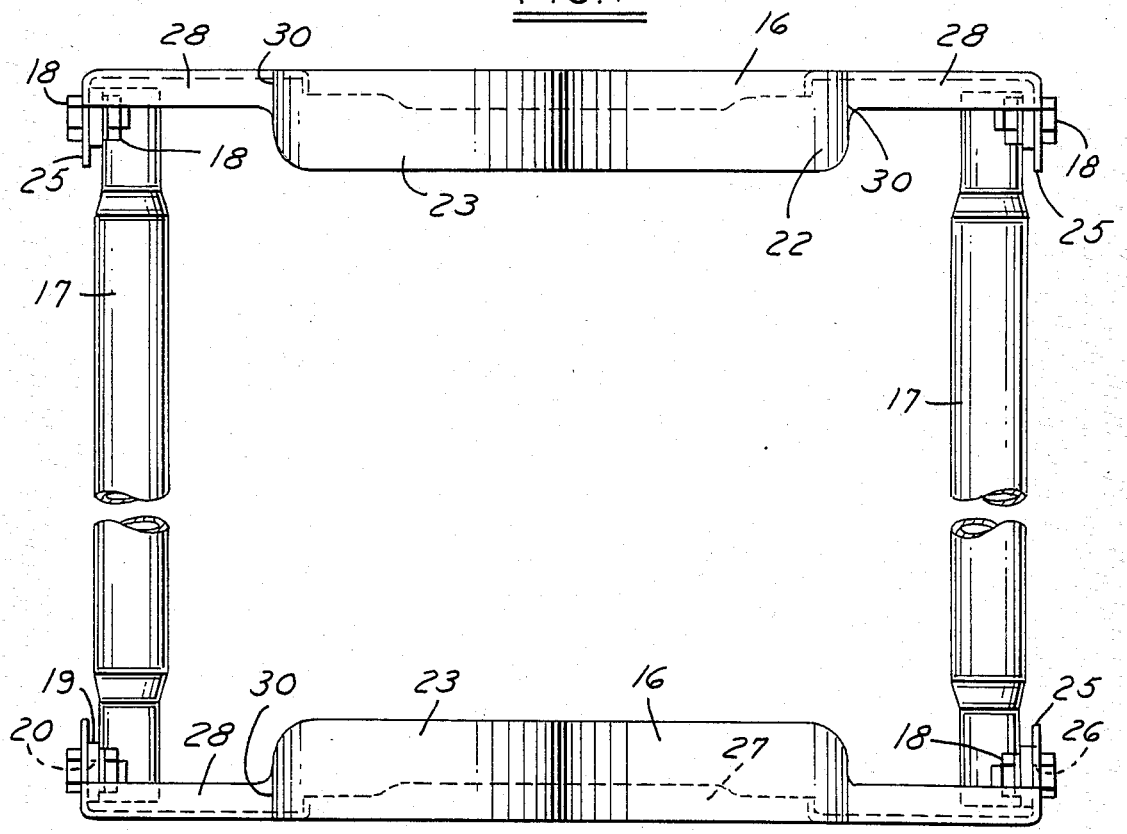
FIG. 7 is a fragmentary plan view of a single module.

Referring now to the drawings, the drum storage rack 10 is shown with a plurality of drums 11 stored on the rack 10. Four, three, and two module units 12, 13, and 14, shown in FIGS. 1, 3 and 4, are made up of the same modular components assembled in various combinations to provide a drum storage rack with the proper storage capacity for a particular application.

Referring now to FIG. 6, the components of the modular units are shown in detail. Each module includes two end plates 16 that are interconnected by two crossbars 17. The end plates 16 are preferably formed from heavy gauge steel stampings or other structurally rigid material. A crossbar 17 is attached by means of fasteners 18 to opposite sides of each end plate 16. It should be noted that when two modules are assembled together in abutting relationship only one crossbar 17 is required to support adjacent end plates 16. For example, in a four module unit 12 five crossbars 17 are required to support all of the end plates 16 in their proper orientation.

The crossbars 17 in the illustrated embodiment are tubular members made of steel or another structurally durable material. Opposite ends of the crossbar 17 are welded to reinforcement plates 19 which have holes 20 formed therethrough for receiving the fasteners 18 to secure the crossbar to the end plates 16.

Each of the end plates 16 include a face portion 21 which is bounded by a rim portion 22. The rim portion 22 is a flange oriented substantially perpendicularly to the face 21 and extends about the periphery of the face 21. The rim portion 22 provides added strength for the end plate 16.

A top drum receiving surface 23 is formed on the upper portion of the end plate 16, as shown in FIG. 6. The top drum receiving surface 23 is preferably a V-shaped area upon which a 55 gallon drum or a 30 gallon drum may be centrally received. Similarly, a V-shaped bottom drum receiving surface-24 is formed on the bottom portion of the end plate 16 for stacking the module on top of a storage drum 11. Top and bottom drum receiving portions 23 and 24 are preferably identical in shape so the end plate 16 may be reversed without effecting the performance of the drum storage rack. The bottom of the end plate is also adapted to securely support the rack on a flat surface such as a floor.

Rectangular lift extensions 25 are formed in the rim 22 at opposite ends of the end plate 16. The rectangular lift extensions 25 include holes 26 at spaced locations which are aligned with the holes 20 formed in the reinforcement plates 16. The holes 26 permit fasteners 18 to secure one or two end plates to each of the reinforcement plates 19 of the crossbar 17.

The face 21 of the end plate 16 includes an aperture 27 in the central portion that is sized to receive a fork truck tine. The aperture 27 is used when two or four module units 14, 11 are handled by inserting the fork truck tines 32 in the aperture 27 of adjacent central modules.

A flat 28 is formed on opposite ends of the bottom portion of the rim 22. The flat 28 when co-located with the flat 28 of an adjacent module forms a pocket 29 for receiving a fork truck tine 32 thereon. The pocket 29 is bounded on each end by sides 30 which are formed as part of the rim 22 and extend substantially perpendicularly to the flat 28. When an odd numbered modular unit is handled such as the three module unit 13 shown in FIG. 3 the pockets 29 on opposite sides of the central module receive the fork truck tines 32.

It should be understood that the two different handling means, apertures 27 and pockets 29 are provided on the end plate 16 to allow a module and the drums carried thereon to be picked up from the end plate 16 side with the weight of the drums balanced on the fork truck tines. An additional advantage of having two different handling means is that a four module unit that is partially loaded with three drums may be lifted as if it were a three module unit by means of the pockets 29, thereby allowing the load to be lifted in a substantially balanced manner.

The drum storage rack of the present invention is also adapted to be lifted from either end by inserting the fork truck tines 32 under the crossbars 17, as shown in FIG. 2. This is important in confined storage areas such as loading docks or in shipping vehicles where the drum storage rack must be maneuvered into position. In such situations it is frequently necessary to lift a load from various orientations because it is not always possible to lift a drum storage rack by the end plates 16.

As shown in FIG. 5, the drum storage rack 10 of the present invention may be nested for storage or shipment when they are not loaded with storage drums. Two module units 14 are stacked in a nested arrangement by either hand stacking the units one on top of another or by means of fork truck tines 32 being inserted in the central aperture 27. A considerable number of empty modular units may be stacked one on top of another because the units interlock with one another so that the crossbars 17 are aligned vertically. The modular units are stacked with the end plates staggered to be partially abutting with vertically adjacent units wherein the flats 28 of an upper unit rest upon the top surface of the crossbars 17 of a lower unit on one end, while on the other end, flats 28 on the upper side of the lower unit support the crossbars of the upper unit. The interlocked stacking of the racks permits empty racks to be returned neatly organized and ready for reuse in the minimum amount of space.

It should be understood that the end plates 16 are symmetrical in shape so that they are difficult to misassemble. In the disclosed embodiment the top and bottom barrel receiving portions 23 and 24 are identical. Likewise, the rectangular lift extensions 25, flat 28, and sides 30 of the pockets are symmetrical about the vertical central axis of the end plate so that it is difficult to misassemble the modules.

The modules are built from two basic components, the end plate 16 and the crossbar 17 which are repeatedly assembled together by means of common fasteners 18. The interchangeability of the common components allows the number of modules in a given rack to be changed according to storage or shipping requirements, by simply adding or removing end plates 16 and crossbars 17 as needed.

The above description is intended to be illustrative of three embodiments of the present invention and should not be construed in a limiting sense. Having fully described the present invention, I now claim:

1. A drum storage rack formed by assembling a plurality of modules together in a laterally abutting arrangement, wherein each of said modules comprises:

first and second end plates having a central axis interconnected by at least one elongated support member;

each of said end plates having a top portion and a bottom portion adapted to receive a drum, with an aperture formed therebetween for receiving a lifting means, and side portions each having an outwardly extending, rectangular lift extension;

said lift extension being shorter in length than said side portion and adapted to be attached to a similar lift extension on a laterally adjacent module forming a flat walled pocket for receiving a lifting means parallel to said central axis.

2. The drum storage rack of claim 1 wherein a plurality of said modules are assembled together.

3. The drum storage rack of claim 1, wherein two inner modules are laterally assembled together between two outer modules with the lift extensions of said first and second end plates of adjacent modules being secured together, said central apertures of the two inner modules being adapted to receive a lifting means.

4. The drum storage rack of claim 1, further including means for receiving lifting means perpendicular to said central axis.

5. The drum storage rack of claim 4, wherein a plurality of crossbars are provided and said receiving means comprises a space between said cross bars.

6. The drum storage rack of claim 1, wherein said top portion is identical to said bottom portion.

7. The drum storage rack of claim 1, wherein, said first and second end plates are identical.

8. The drum storage rack of claim 1, wherein said first and second end plates are each symmetrical relative to a central axes extending through the central aperture of each of said first and second end plates.

9. The drum storage tank of claim 1, wherein said modules are adpated to be stacked interlocked with one another when empty with a first end plate of one module resting on the first cross bar of the lower module on one end and the cross bar of said one module resting on the second end plate of said lower module at the opposite end.

10. The drum storage rack of claim 1, wherein three modules are laterally assembled together said lift extensions of said first and second end plates of adjacent modules being secured together forming a pocket between the inner module and each outer module for receiving a lifting means parallel to said central axis whereby said three modules may be raised in a balanced and stable manner.

* * * * *